US011581636B2

(12) United States Patent
Guo et al.

(10) Patent No.: US 11,581,636 B2
(45) Date of Patent: Feb. 14, 2023

(54) BASE STATION ANTENNA WITH FREQUENCY SELECTIVE SURFACE

(71) Applicant: CommScope Technologies LLC, Hickory, NC (US)

(72) Inventors: Pengfei Guo, Suzhou (CN); Yunzhe Li, Suzhou (CN); Jiajia Ni, Suzhou (CN); Chao Teng, Suzhou (CN)

(73) Assignee: CommScope Technologies LLC, Hickory, NC (US)

( * ) Notice: Subject to any disclaimer, the term of this patent is extended or adjusted under 35 U.S.C. 154(b) by 11 days.

(21) Appl. No.: 17/316,858

(22) Filed: May 11, 2021

(65) Prior Publication Data

US 2021/0391647 A1 Dec. 16, 2021

(30) Foreign Application Priority Data

Jun. 10, 2020 (CN) ..... 202010521800.3

(51) Int. Cl.

| | |
|---|---|
| ***H01Q 1/52*** | (2006.01) |
| ***H01Q 9/04*** | (2006.01) |
| ***H01Q 21/08*** | (2006.01) |
| ***H01Q 1/24*** | (2006.01) |

(52) U.S. Cl.

CPC ..... *H01Q 1/523* (2013.01); *H01Q 1/246* (2013.01); *H01Q 9/0407* (2013.01); *H01Q 21/08* (2013.01)

(58) Field of Classification Search

CPC ..... H01Q 1/246; H01Q 1/52; H01Q 1/521; H01Q 1/523; H01Q 21/06; H01Q 21/061; H01Q 21/062; H01Q 21/065; H01Q 21/08; H01Q 9/0407; H01Q 5/40; H01Q 5/48; H01Q 19/108

See application file for complete search history.

(56) References Cited

U.S. PATENT DOCUMENTS

| | | | | |
|---|---|---|---|---|
| 7,688,269 | B1 * | 3/2010 | West | H01Q 5/42 333/125 |
| 10,439,285 | B2 | 10/2019 | Isik et al. | |
| 2018/0108985 | A1 * | 4/2018 | Wang | H01Q 1/525 |
| 2018/0277946 | A1 * | 9/2018 | Murata | H01Q 1/38 |

(Continued)

FOREIGN PATENT DOCUMENTS

| | | | |
|---|---|---|---|
| CN | 210224283 | U | 3/2020 |
| KR | 20120086841 | A | 8/2012 |

(Continued)

OTHER PUBLICATIONS

"European Search Report corresponding to European Application No. 21178811.2, dated Nov. 10, 2021, 18 pages".

*Primary Examiner* — Jason Crawford
(74) *Attorney, Agent, or Firm* — Myers Bigel, P.A.

(57) ABSTRACT

A base station antenna comprises a plurality of columns of first radiating elements configured for operating in a first operational frequency band, each column of first radiating elements comprising a plurality of first radiating elements arranged in a longitudinal direction and an isolation wall positioned between adjacent columns of first radiating elements and extending in the longitudinal direction. The isolation wall comprises a frequency selective surface configured such that electromagnetic waves within the first operational frequency band are substantially blocked by the isolation wall.

18 Claims, 8 Drawing Sheets

(56) References Cited

U.S. PATENT DOCUMENTS

| | | | | |
|---|---|---|---|---|
| 2018/0358710 | A1 | 12/2018 | Toyao et al. | |
| 2019/0237874 | A1 | 8/2019 | Michaelis et al. | |
| 2020/0076072 | A1* | 3/2020 | Keyrouz | H05K 1/0236 |
| 2020/0091599 | A1* | 3/2020 | Nakamura | H01Q 1/38 |
| 2020/0176873 | A1* | 6/2020 | Segador Alvarez | H01Q 1/246 |
| 2021/0296785 | A1* | 9/2021 | Zimmerman | H01Q 21/062 |
| 2021/0391647 | A1* | 12/2021 | Guo | H01Q 19/106 |

FOREIGN PATENT DOCUMENTS

| | | | |
|---|---|---|---|
| WO | 2020239190 | A1 | 12/2020 |
| WO | 2021042862 | A1 | 3/2021 |

* cited by examiner

BASE STATION ANTENNA WITH FREQUENCY SELECTIVE SURFACE

CROSS-REFERENCE TO RELATED APPLICATION

The present application claims priority to Chinese Patent Application No. 202010521800.3, filed Jun. 10, 2020, the entire content of which is incorporated herein by reference as if set forth fully herein.

FIELD

The present invention relates generally to the field of antennas, and more particularly, to a base station antenna with a frequency selective surface.

BACKGROUND

With the development of wireless communication technologies, the requirements of integration and miniaturization of antennas become higher and higher, which leads to an increasingly large number of columns of radiating elements included in the antenna and, accordingly, smaller distances between adjacent columns of radiating elements. This may result in increased mutual coupling between adjacent columns of radiating elements, which may make it challenging for the antenna to realize high integration and miniaturization while maintaining high performance. For example, in some multi-band antenna applications, a low frequency band may refer to a frequency range of 600-960 MHz, and a high frequency band may refer to a frequency range of 1400-2700 MHz, or a frequency range of 3000-5000 MHz for 5G. In a limited space inside the antenna, low-band radiating elements have larger size as compared to high-band radiating elements, which causes more severe mutual coupling between columns of low-band radiating elements, which may result in poor inter-band isolation performance between the columns of low-band radiating elements.

SUMMARY

According to an aspect of the present disclosure, a base station antenna that extends along a longitudinal direction is provided, which comprises: a plurality of columns of first radiating elements configured for operating in a first operational frequency band, each column of first radiating elements comprising a plurality of first radiating elements arranged in the longitudinal direction; and an isolation wall positioned between adjacent columns of first radiating elements and extending in the longitudinal direction, wherein the isolation wall comprises a frequency selective surface configured such that electromagnetic waves within the first operational frequency band are substantially blocked by the isolation wall.

In some embodiments, the frequency selective surface is configured to reflect the electromagnetic waves within the first operational frequency band.

In some embodiments, the base station antenna further comprises a plurality of columns of second radiating elements configured for operating in a second operational frequency band that is different from and does not overlap with the first operational frequency band, each column of second radiating elements comprising a plurality of second radiating elements arranged in the longitudinal direction, wherein the frequency selective surface is further configured such that electromagnetic waves within the second operational frequency band can propagate through the isolation wall.

In some embodiments, the second operational frequency band is higher than the first operational frequency band.

In some embodiments, the isolation wall comprises the frequency selective surface on a printed circuit board.

In some embodiments, the isolation wall comprises a dielectric board having opposite first and second sides, the first and second sides facing respective columns of first radiating elements, each formed with a periodic conductive structure, the periodic conductive structures forming the frequency selective surface.

In some embodiments, the isolation wall comprises a plurality of isolation units arranged periodically, each isolation unit comprising a first unit structure forming the periodic conductive structure on the first side of the dielectric board and a second unit structure forming the periodic conductive structure on the second side of the dielectric board, a position of the first unit structure included in each isolation unit on the first side of the dielectric board corresponding to a position of the second unit structure included in that isolation unit on the second side of the dielectric board.

In some embodiments, the periodic conductive structure on the first side of the dielectric board comprises a grid array structure, the first unit structure comprises a grid serving as a repetition unit in the grid array structure, and the periodic conductive structure on the second side of the dielectric board comprises a patch array structure, the second unit structure comprises a patch serving as a repetition unit in the patch array structure.

In some embodiments, the first unit structure further comprises projecting portions projecting from corners of the grid towards a center of the grid and/or projecting portions projecting from middle points of sides of the grid towards the center of the grid.

In some embodiments, the projecting portions have a strip shape or a cross shape, the cross shape comprising two strip shapes perpendicular to each other.

In some embodiments, the first unit structure comprises a square grid, and the second unit structure comprises a square patch.

In some embodiments, the first unit structure further comprises strip-shaped projecting portions projecting from four corners of the square grid towards a center of the square grid.

In some embodiments, the first unit structure further comprises cross-shaped projecting portions projecting from four corners of the square grid towards a center of the square grid and strip-shaped projecting portions projecting from middle points of four sides of the square grid towards the center of the square grid, the cross-shaped projecting portions comprising two strip-shaped portions perpendicular to each other.

In some embodiments, the periodic conductive structures on the first and second sides of the dielectric board are formed of metal.

In some embodiments, the base station antenna comprises a plurality of the isolation walls, each isolation wall disposed at different rows of radiating elements between the adjacent columns of first radiating elements.

In some embodiments, the base station antenna further comprises a parasitic element disposed on top of the isolation wall.

In some embodiments, the plurality of first radiating elements are cloaked radiating elements.

In some embodiments, the isolation wall is a first isolation wall, and the base station antenna further comprises a second isolation wall positioned between adjacent columns of second radiating elements and extending in the longitudinal direction, the second isolation wall comprising a frequency selective surface configured such that the electromagnetic waves within the second operational frequency band are substantially blocked by the second isolation wall.

In some embodiments, the first isolation wall is also positioned between the adjacent columns of second radiating elements, and the second isolation wall is also positioned between the adjacent columns of first radiating elements.

In some embodiments, the first isolation wall and the second isolation wall are integrally formed by a multi-layer printed circuit board.

In some embodiments, the base station antenna comprises a plurality of the first isolation walls and a plurality of the second isolation walls arranged alternately in a column, wherein each first isolation wall is disposed at different rows of radiating elements between the adjacent columns of first radiating elements, and each second isolation wall is disposed at different rows of radiating elements between the adjacent columns of second radiating elements.

In some embodiments, a height of the isolation wall is larger than a height of a first radiating element of the plurality of first radiating element.

In some embodiments, the isolation wall is implemented as a multi-layer printed circuit board, one or more layers of which formed with a frequency selective surface configured such that electromagnetic waves within a predetermined frequency range cannot propagate through the isolation wall, and wherein a combination of predetermined frequency ranges associated with the one or more layers of the multi-layer printed circuit board covers the first operational frequency band.

According to another aspect of the present disclosure, a multi-band base station antenna is provided, which comprises: a plurality of columns of low-band radiating elements configured for operating in a low frequency band, each column of low-band radiating elements comprising a plurality of low-band radiating elements arranged in a longitudinal direction; a plurality of columns of high-band radiating elements configured for operating in a high frequency band that is higher than and does not overlap with the low frequency band, each column of high-band radiating elements comprising a plurality of high-band radiating elements arranged in the longitudinal direction; and an isolation wall positioned between adjacent columns of low-band radiating elements and extending in the longitudinal direction, wherein the isolation wall comprises a frequency selective surface configured to reflect electromagnetic waves within the low frequency band while enabling electromagnetic waves within the high frequency band to propagate through the isolation wall.

Figure 1:
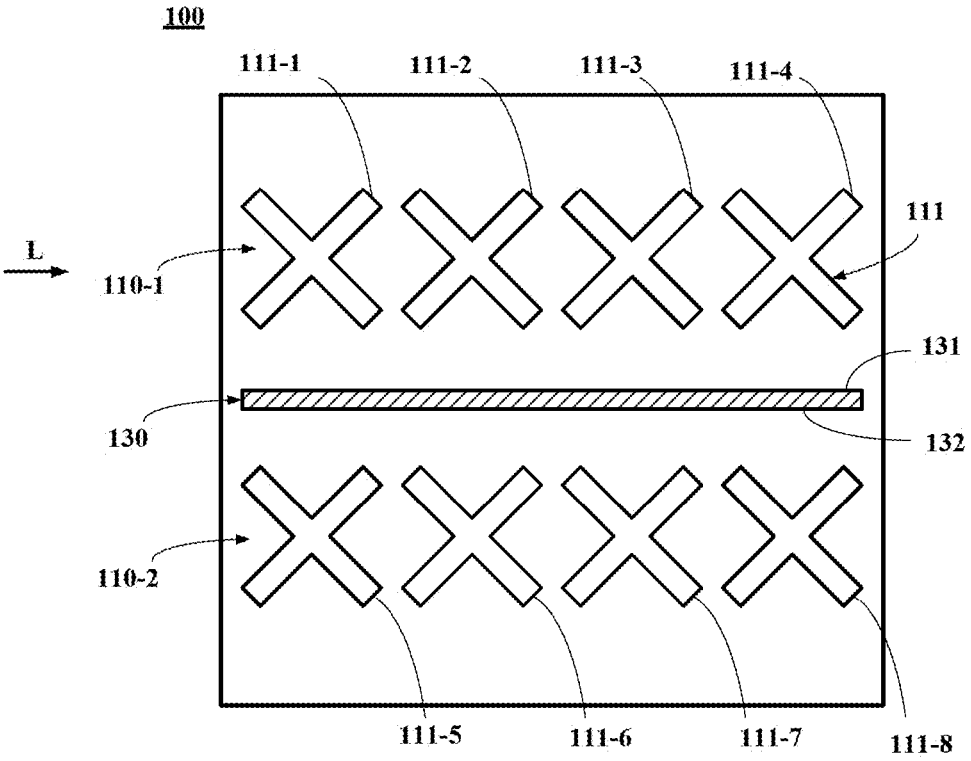
FIG. 1 is a front view schematically illustrating an example of a base station antenna according to some embodiments of the present disclosure.

Note that in the embodiments described below, sometimes a same reference sign is used in common among different accompanying drawings to denote the same portions or portions having the same function, but a repetitive description thereof will be omitted. In some cases, similar items are denoted using similar reference signs and letters, and thus, once an item is defined in a drawing, it need not be discussed further in subsequent drawings.

For convenience of understanding, the positions, dimensions, ranges and the like of the respective structures shown in the drawings and the like sometimes do not indicate actual positions, dimensions, ranges and the like. Therefore, the present disclosure is not limited to the positions, dimensions, ranges and the like disclosed in the drawings and the like.

DETAILED DESCRIPTION

Various exemplary embodiments of the present disclosure will be described in detail below with reference to the accompanying drawings. It should be noted that: the relative arrangement of parts and steps, numerical expressions and numerical values set forth in these embodiments do not limit the scope of the present disclosure unless specifically stated otherwise.

The following description of at least one exemplary embodiment is merely illustrative in nature and is in no way intended to limit the present disclosure, and its applications or uses. That is, the structures and methods herein are illustrated by way of example to illustrate different embodiments of the structures and methods of the present disclosure. Those skilled in the art will understand, however, that they are merely illustrative of exemplary implementations of the present disclosure but not exhaustive. Furthermore, the drawings are not necessarily drawn to scale, and some features may be exaggerated to show details of particular components.

Additionally, techniques, methods, and devices known to one of ordinary skill in the relevant art may not be discussed in detail but are intended to be part of the granted specification where appropriate.

In all examples illustrated and discussed herein, any particular value should be construed as exemplary only and not as limiting. Thus, other examples of the exemplary embodiments may have different values.

As discussed above, as integration and miniaturization requirements for antennas have increased, developing techniques for reducing mutual coupling between different columns of radiating elements at the same frequency band and improving inter-band isolation performance has become an important aspect in the design of a base station antenna. It generally is more difficult to significantly reduce coupling between columns of low frequency band (low-band) radiating elements (such as 600-960 MHz and the like) than it is to realize decoupling between columns of high frequency band (high-band) radiating elements (such as 1400-2700 MHz, 3000-5000 MHz, and the like) due to the large size of the low-band radiating elements. For example, in an antenna comprising two columns of low-band radiating elements and four columns of high-band radiating elements that has a width of 430 mm, the distance between two adjacent columns of low-band radiating elements can only be about 215 mm due to the small width of the antenna. In such a compact arrangement, the strong mutual coupling between the columns of low-band radiating elements may cause poor inter-band isolation performance.

A frequency selective surface may filter electromagnetic waves in a space. A metamaterial with particular reflection/transmission phase distributions may be formed by periodically arranging a plurality of frequency selective surface units on a two-dimensional plane. When electromagnetic waves are incident on the frequency selective surface, the frequency selective surface may selectively pass/block electromagnetic waves at different frequencies.

An aspect of the present disclosure provides a base station antenna that extends along a longitudinal direction, which comprises a plurality of columns of first radiating elements configured for operating in a first operational frequency band, each column of first radiating elements comprising a plurality of first radiating elements arranged in the longitudinal direction of the base station antenna. The base station antenna further comprises an isolation wall positioned between adjacent columns of first radiating elements and extending in the longitudinal direction, wherein the isolation wall comprises a frequency selective surface configured such that electromagnetic waves within the first operational frequency band are substantially blocked from passing through the isolation wall. The base station antenna according to the present disclosure can effectively improve the inter-band isolation performance between columns of radiating elements at the same frequency band while not affecting the beam pattern performance of the other operational frequency band(s).

An example base station antenna 100 according to some embodiments of the present disclosure is now described in detail with reference to FIG. 1. It should be noted that other components may be present in the actual base station antenna that are not shown in the drawings and discussed herein in order to avoid obscuring the gist of the present disclosure. It should also be noted that FIG. 1 only schematically shows relative positional relationships between the respective components without specially defining the particular structures of the respective components.

Figure 5:
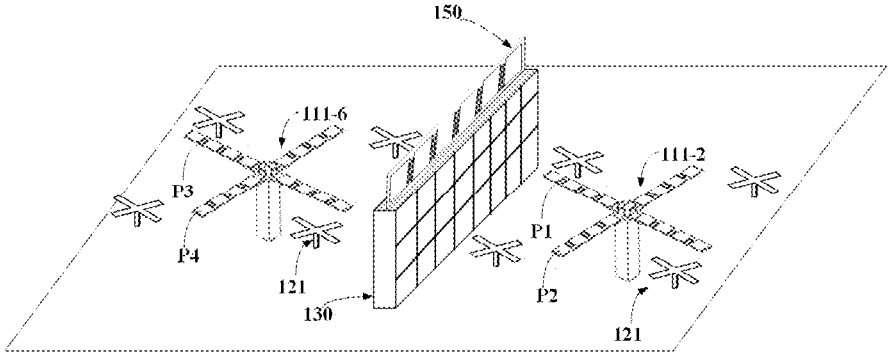
FIG. 5 is a schematic enlarged perspective view of a portion enclosed by a dash box in the base station antenna of FIG. 4.

As shown in FIG. 1, the base station antenna 100 may comprise a plurality of columns 110-1, 110-2 of first radiating elements (which may also be collectively referred to hereinafter as the columns 110 of first radiating elements) configured for operating in a first operational frequency band. Each column 110 of first radiating elements comprises a plurality of first radiating elements 111 arranged in a longitudinal direction (as indicated by the arrow L in FIG. 1). As shown in FIG. 1, column 110-1 includes first radiating elements 111-1, 111-2, 111-3, and 111-4, and column 110-2 includes first radiating elements 111-5, 111-6, 111-7, and 111-8, where the first radiating elements 111-1 and 111-5, the first radiating elements 111-2 and 111-6, the first radiating elements 111-3 and 111-7, and the first radiating elements 111-4 and 111-8 are arranged in respective first through fourth rows of radiating elements. Although FIG. 1 illustrates the base station antenna 100 as having two columns of first radiating elements and each column of first radiating elements comprises four first radiating elements, it will be appreciated that the base station antenna 100 may include additional columns of radiating elements that operate in the same or different operational frequency bands, and that each column of radiating elements may comprise more or fewer radiating elements. In some embodiments, the first radiating elements may be low-band radiating elements, and the first operational frequency band may be a low frequency band. In other embodiments, the first radiating elements may be high-band radiating elements, and the first operational frequency band may be a high frequency band. The "low frequency band" as used herein refers to a lower frequency band such as, for example, the 600-960 MHz frequency band or a portion thereof, and the "high frequency band" as used herein refers to a higher frequency band such as, for example, the 1400-2700 MHz frequency band or a portion thereof. The present disclosure is not limited to these particular frequency bands, and may also be applied to any other frequency band within the operational frequency range of the base station antenna. In some embodiments, the first radiating elements may be cloaked radiating elements, e.g., the first radiating elements 111-2, 111-6 as depicted in FIG. 5.

The base station antenna 100 further comprises an isolation wall 130. The isolation wall 130 is positioned between adjacent columns of first radiating elements (i.e., between columns 110-1 and 110-2 of first radiating elements) and extends in the longitudinal direction (as indicated by the arrow L in FIG. 1) of the base station antenna 100. The isolation wall 130 comprises a frequency selective surface configured such that electromagnetic waves in the first operational frequency band are substantially blocked by the isolation wall. For example, the isolation wall may reflect and/or absorb electromagnetic waves in the first operational frequency band. Embodiments in which the frequency selective surface is configured to reflect the electromagnetic waves in the first operational frequency band may have lower loss than embodiments in which the frequency selective surface absorbs the electromagnetic waves in the first operational frequency band. Generally, the isolation wall 130 does not physically contact any of the first radiating elements.

In some embodiments, the isolation wall 130 is positioned in the middle of the columns 110-1 and 110-2 of first radiating elements. In some embodiments, the isolation wall 130 may extend farther forwardly from the reflector than do the first radiating elements 111, e.g., as shown in FIG. 5. Herein, referring to FIG. 5, a distance that the isolation wall 130 or the first radiating elements 111 extend forwardly from the reflector may be regarded as a "height" of the isolation wall 130 or the first radiating elements 111. As shown in FIG. 5, the height of the isolation wall 130 is larger than the heights of the first radiating elements 111. When factors such as installation conflicts are not considered, the farther forwardly the isolation wall extends, the better the decoupling effect is.

As shown in FIG. 1, the isolation wall 130 longitudinally extends across all the first radiating elements 111 in the columns 110 of first radiating elements. The isolation wall 130 may also have other arrangements. In some embodiments, the base station antenna may comprise a plurality of isolation walls, each isolation wall disposed at different rows of radiating elements between the adjacent columns of first radiating elements, i.e., disposed between the radiating elements in different rows of radiating elements. For example, in some embodiments, two or more adjacent rows of radiating elements in the adjacent columns of first radiating elements may share an isolation wall. In some embodiments, each isolation wall may extend across one or more rows of radiating elements between the adjacent columns of first radiating elements.

Figure 2:
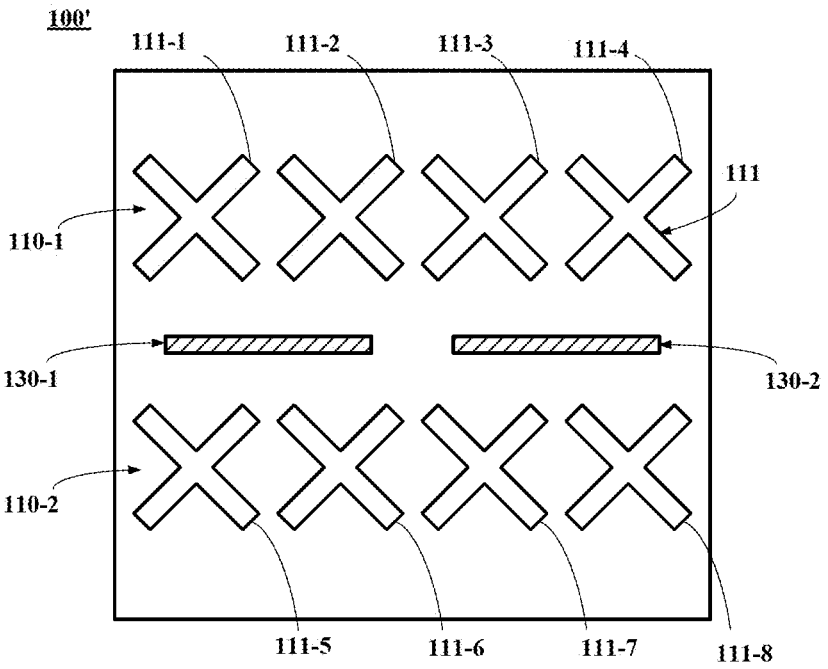
FIG. 2 is a front view schematically illustrating an example of a base station antenna according to some embodiments of the present disclosure.

For example, as shown in FIG. 2, another example 100' of the base station antenna according to the present disclosure comprises two isolation walls 130-1, 130-2, where isolation wall 130-1 is between the first radiating elements in the upper two rows of first radiating elements (i.e., isolation wall 130-1 is between first radiating elements 111-1 and 111-2 and first radiating elements 111-5 and 111-6), and isolation wall 130-2 is between the first radiating elements in the lower two rows of first radiating elements (i.e., isolation wall 130-2 is between first radiating elements 111-3 and 111-4 and first radiating elements 111-7 and 111-8). The isolation walls 130-1, 130-2 may be connected with each other, or may be separated from each other. The isolation walls 130-1, 130-2 may be aligned with each other, or may be arranged at an angle to each other, or may be arranged offset in parallel to each other. These specific arrangements and three-dimensional sizes of the isolation walls may depend on the required degree of decoupling between columns of radiating elements of the base station antenna in specific application scenarios. The frequency selective surfaces of the isolation walls 130-1, 130-2 are not necessarily identical, as long as they are capable of reducing and/or preventing the electromagnetic waves within the first operational frequency band from propagating through the isolation walls, that is to say, the pass bands and stop bands of the frequency selective surfaces of the isolation walls 130-1, 130-2 are not necessarily identical, as long as the stop bands cover the first operational frequency band. It will be appreciated that, although it is shown in FIG. 2 that the isolation walls 130-1, 130-2 extend across a same number of rows of radiating elements, the isolation walls may also extend across a different number of rows of radiating elements in other embodiments.

Figure 3:
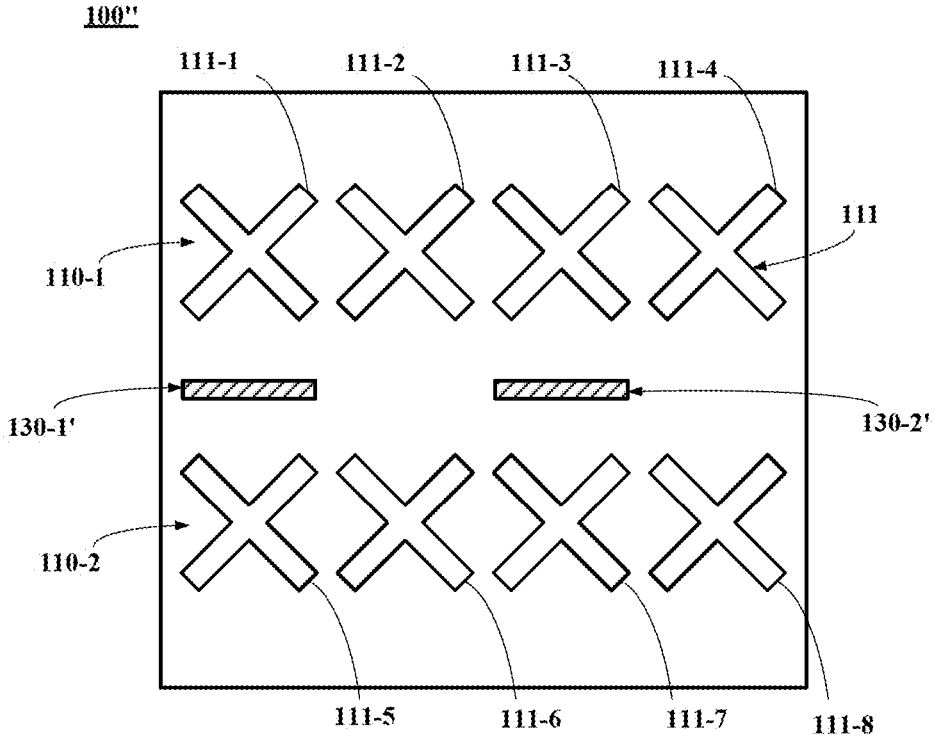
FIG. 3 is a front view schematically illustrating an example of a base station antenna according to some embodiments of the present disclosure.

In some embodiments, the base station antenna may comprise one or more isolation walls that only extend across some of the rows of radiating elements in the adjacent columns of first radiating elements. For example, as shown in FIG. 3, another example 100" of the base station antenna according to the present disclosure comprises two isolation walls 130-1', 130-2', where isolation wall 130-1' is between first radiating elements 111-1 and 111-5 and isolation wall 130-2' is between first radiating elements 111-3 and 111-7, and no isolation wall is present between first radiating elements 111-2 and 111-6, 111-4 and 111-8. One or more isolation walls may be selectively arranged at some positions between the adjacent columns of radiating elements depending on the required degree of decoupling between columns of radiating elements of the base station antenna in specific application scenarios.

In some embodiments, the base station antenna may also include parasitic elements that are mounted on or adjacent the forward surface of some or all of the isolation walls. For example, as shown in FIG. 5, a parasitic element 150 is mounted on the forward surface of the isolation wall 130 (disposed on top of the isolation wall 130). In some embodiments, these parasitic elements may be cloaked parasitic elements. In some embodiments, the parasitic elements may extend in parallel to the isolation wall. In other embodiments, the parasitic element may be rotated by 90 degree with respect to the isolation wall.

In some embodiments, the base station antenna may further comprise a plurality of columns of second radiating elements configured for operating in a second operational frequency band that is different from and does not overlap with the first operational frequency band. Each column of second radiating elements may include a plurality of second radiating elements arranged in the longitudinal direction, and the frequency selective surface may be configured such that electromagnetic waves within the second operational frequency band can propagate through the isolation wall.

A base station antenna 200 according to further embodiments of the present disclosure is now described with reference to FIG. 4. Compared to the base station antenna 100, the base station antenna 200 further comprises a plurality of columns 120-1, 120-2, 120-3, and 120-4 of second radiating elements (which may also be collectively referred to hereinafter as the columns 120 of second radiating elements), each column 120 of second radiating elements comprises a plurality of second radiating elements 121 arranged in the longitudinal direction of the base station antenna. The second radiating elements 121 are configured to operate in a second operational frequency band that is different from and does not overlap with the first operational frequency band. Generally, the isolation wall 130 does not contact any of the second radiating elements 121.

In some embodiments, the second operational frequency band may be higher than the first operational frequency band. In some embodiments, the first radiating elements may be low-band radiating elements and the first operational frequency band may be a low frequency band, and the second radiating elements may be high-band radiating elements and the second operational frequency band may be a high frequency band. In other embodiments, the first radiating elements may be high-band radiating elements and the first operational frequency band may be a high frequency band, and the second radiating elements may be low-band radiating elements and the second operational frequency band may be a low frequency band.

Figure 4:
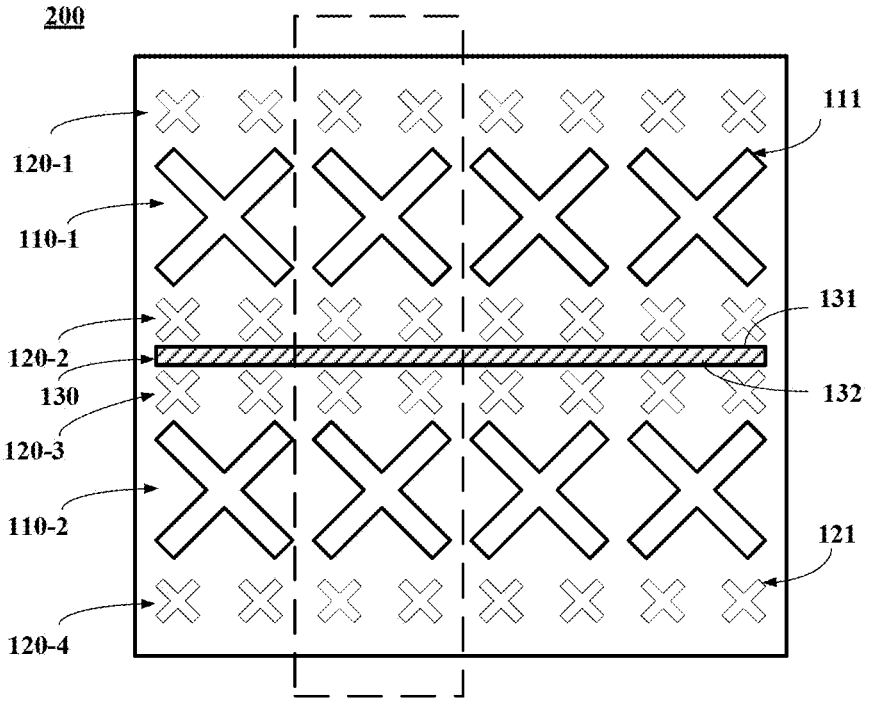
FIG. 4 is a front view schematically illustrating an example of a base station antenna according to some embodiments of the present disclosure.

Although it is shown in FIG. 4 that the base station antenna 200 comprises two columns of first radiating elements, each column of first radiating elements comprising four first radiating element, and four columns of second radiating elements, each columns of second radiating elements comprising eight second radiating element, it will be appreciated that the base station antenna 200 may also comprise more or fewer columns of first radiating elements and/or columns of second radiating elements, may also additionally comprise columns of radiating elements that operate in other operational frequency bands, and each column of radiating elements may comprise more or fewer radiating elements.

Furthermore, the frequency selective surface of the isolation wall 130 of the base station antenna 200 is further configured such that the electromagnetic waves within the second operational frequency band can propagate through the isolation wall 130. That is to say, the isolation wall 130 can substantially reduce and/or prevent the propagation of the electromagnetic waves within the first operational frequency band without significantly affecting the propagation of the electromagnetic waves within the second operational frequency band. Therefore, the isolation wall 130 can reduce the mutual coupling between the columns of first radiating elements while not affecting the performance of the columns of second radiating elements. Furthermore, the present disclosure is not limited to a dual-band base station antenna. For example, the base station antenna according to the present disclosure may be a multi-band base station antenna, and the first and second operational frequency bands may be any two operational frequency bands of the multi-band base station antenna, additionally, the multi-band base station antenna may further comprise at least a third operational frequency band that is different from and does not overlap with the first and second operational frequency bands, and the frequency selective surface may be further configured to allow electromagnetic waves within the third operational frequency band to pass through the isolation wall, such that the isolation wall can reduce the mutual coupling between the columns of radiating elements corresponding to the first operational frequency band while not affecting the performance of the columns of radiating element corresponding to other operational frequency bands.

In embodiments where the first radiating elements are low-band radiating elements and the second radiating elements are high-band radiating elements, since the low-band radiating elements have larger size than the high-band radiating elements, the inter-band isolation performance is influenced by the mutual coupling between the columns at the same frequency band (a lower frequency band such as 600-960 MHz) to a greater extent, but the isolation wall 130 of the base station antenna 200 can effectively reduce the mutual coupling between the columns of low-band radiating elements, thereby improving the inter-band isolation performance. All the above discussions regarding the arrangement of the isolation wall 130 may also be applicable to the arrangement of the isolation wall 130 of the base station antenna 200 and will not be described repeatedly herein.

In some embodiments, the base station antenna may also comprise a second isolation wall positioned between adjacent columns of second radiating elements and extending in the longitudinal direction, the second isolation wall comprising a frequency selective surface configured such that the electromagnetic waves within the second operational frequency band are substantially blocked by the second isolation wall.

Figure 6:
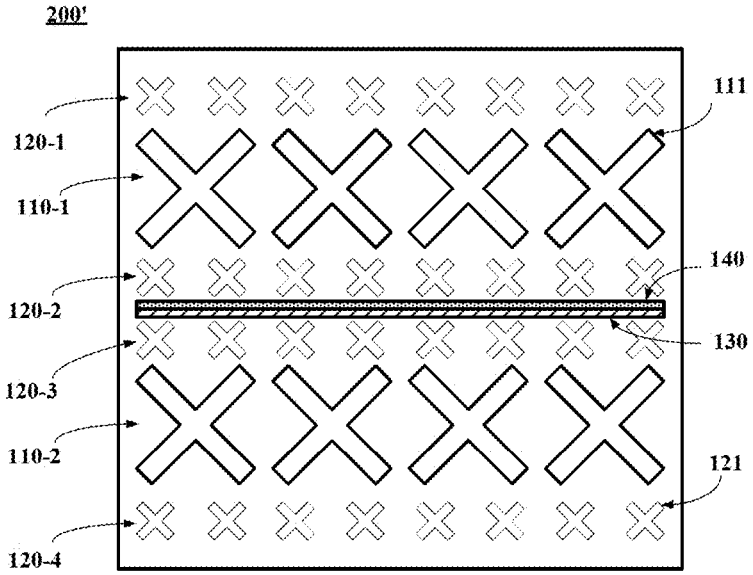
FIG. 6 is a front view schematically illustrating an example of a base station antenna according to some embodiments of the present disclosure.

For example, as shown in FIG. 6, another example 200' of the base station antenna according to the embodiments of the present disclosure further includes an isolation wall 140 that includes a frequency selective surface configured such that the electromagnetic waves within the second operational frequency band cannot substantially pass through the isolation wall 140. The frequency selectivity of the isolation wall 140 to the first operational frequency band is not particularly limited. In some embodiments, the isolation wall 140 may allow the electromagnetic waves within the first operational frequency band to pass therethrough. In some embodiments, the isolation wall 140 may not allow the electromagnetic waves within the first operational frequency band to pass therethrough. In some embodiments, the isolation wall 140 may extend farther forwardly than the second radiating elements 121. When factors such as installation conflicts are not considered, the higher the isolation wall is, the better the decoupling effect is. In some embodiments, the height of the isolation wall 140 may be the same as the height of the isolation wall 130.

As shown in FIG. 6, isolation wall 140 may be positioned adjacent isolation wall 130, and they may each extend the entire length of the column of radiating elements. It will be appreciated that isolation wall 140 may be spaced apart from isolation wall 130. And as discussed above, a plurality of the combinations of such isolation walls 140 and 130 may be disposed at different rows of radiating elements, respectively, and is not described repeatedly herein. In some embodiments, the isolation walls 140 and 130 are integrally formed using a multi-layer printed circuit board.

Figure 7:
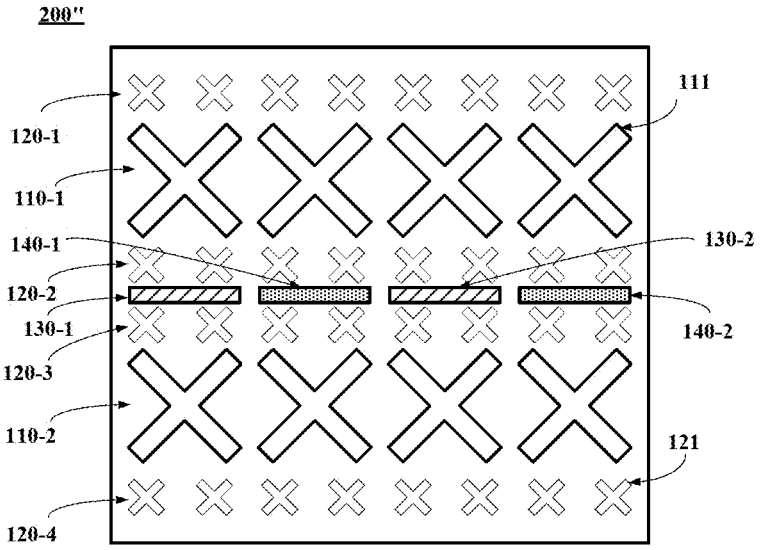
FIG. 7 is a front view schematically illustrating an example of a base station antenna according to some embodiments of the present disclosure.

In some embodiments, the base station antenna may further comprise a plurality of first isolation walls (e.g., multiple isolation walls 130) and a plurality of second isolation walls (e.g., multiple isolation walls 140) that are arranged alternately in a column, where each first isolation wall is disposed at different rows of radiating elements between the adjacent columns of first radiating elements, i.e., disposed between the radiating elements in different rows of radiating elements, and each second isolation wall is disposed at different rows of radiating elements between the adjacent columns of second radiating elements, i.e., disposed between the radiating elements in different rows of radiating elements. For example, FIG. 7 shows another arrangement of the isolation walls 130 and 140. The base station antenna 200" shown in FIG. 7 comprises two isolation walls 130-1, 130-2, and two isolation walls 140-1, 140-2, and these isolation walls are arranged alternately in a column in an order of 130-1, 140-1, 130-2, 140-2. It will be appreciated that the arrangement of the isolation walls shown in the figure is only exemplary and not restrictive, and that the arrangement order, number, three-dimensional size, and the like of the isolation walls 130, 140 may be set according to the respective requirements of inter-band isolation for columns of first radiating elements and columns of second radiating elements. As discussed above, the frequency selective surfaces of the plurality of first isolation walls are not necessarily identical, as long as they are capable of substantially reducing and/or preventing the electromagnetic waves within the first operational frequency band from passing therethrough, and the frequency selective surfaces of the plurality of second isolation walls are not necessarily identical, as long as they are capable of substantially reducing and/or preventing the electromagnetic waves within the second operational frequency band from passing therethrough.

In the examples of FIGS. 6 and 7, the isolation walls 130, 130-1, 130-2 are positioned between adjacent columns (e.g., 120-2, 120-3) of second radiating elements, and the isolation walls 140, 140-1, 140-2 are positioned between adjacent columns (e.g., 110-1, 110-2) of first radiating elements, but this is only exemplary and not intended to limit the present disclosure. For example, the isolation wall 130 need not necessarily be adjacent isolation wall 140. For antennas comprising a plurality of columns of first radiating elements and/or a plurality of columns of second radiating elements, the isolation wall 130 may be positioned between any two adjacent columns of first radiating elements regardless of the positions of the columns of second radiating elements, and the isolation wall 140 may be positioned between any two adjacent columns of second radiating elements regardless of the positions of the columns of first radiating elements. As space permits, and according to actual needs, an isolation wall 130 may be disposed between every two adjacent columns of first radiating elements, and/or an isolation wall 140 may be disposed between every two adjacent columns of second radiating elements.

A frequency selective surface is a kind of metamaterial, where the term "metamaterial" refers to artificially composite electromagnetic (EM) materials. Metamaterials may comprise sub-wavelength periodic microstructures. The isolation wall of the base station antenna according to the present disclosure selectively rejects some frequency bands and permits other frequency bands to pass therethrough by including the frequency selective surface to operate as a "spatial filter".

In some embodiments, the isolation walls 130, 140 may be implemented by forming the frequency selective surface on a printed circuit board. In some embodiments, the isolation wall comprises the frequency selective surface on a printed circuit board. In some embodiments, the isolation wall may be implemented as a multi-layer printed circuit board, one or more layers of which formed with a frequency selective surface configured such that electromagnetic waves within a predetermined frequency range cannot propagate through the isolation wall, and wherein a combination of predetermined frequency ranges associated with the one or more layers of the multi-layer printed circuit board covers the first operational frequency band. In some embodiments, the combination of the predetermined frequency ranges associated with the one or more layers of the multi-layer printed circuit board does not cover the second operational frequency band. The predetermined frequency ranges associated with the one or more layers of the multi-layer printed circuit board may be different from one another. In some embodiments, the predetermined frequency ranges associated with the one or more layers of the multi-layer printed circuit board may not overlap with one another. In some embodiments, the predetermined frequency ranges associated with the one or more layers of the multi-layer printed circuit board may at least partially overlap with one another. In such embodiments, each layer in the multi-layer printed circuit board that is formed with a frequency selective surface is equivalent to a "spatial filter", and the entire multi-layer printed circuit board equivalently comprises a plurality of cascaded "spatial filters", wherein each "spatial filter" stops (i.e., substantially attenuates and/or reflects) a part of the first operational frequency band, thereby collectively substantially preventing the electromagnetic waves within the first operational frequency band from passing through the isolation wall. As such, the design for the frequency selective surface of each layer of the multi-layer printed circuit board may be simplified while ensuring that the electromagnetic waves within the first operational frequency band are substantially blocked by the isolation wall.

In some embodiments, the isolation wall may comprise a dielectric board having opposed first and second sides that face respective columns of first radiating elements where each side comprises a periodic conductive structure that forms the frequency selective surface. For example, referring back to FIG. 1, the isolation wall 130 may comprise a dielectric board (or a dielectric layer) having a first side 131 and a second side 132, where the first side 131 faces the column 110-1 of first radiating elements, the second side 132 faces the column 110-2 of first radiating elements, and the first and second sides 131, 132 each are formed with a periodic conductive structure. The periodic conductive structures on the first and second sides 131, 132 form the frequency selective surface that may substantially prevent the electromagnetic waves within the first operational frequency band from passing through the isolation wall while allowing the electromagnetic waves within the second operational frequency band to pass through the isolation wall.

In some embodiments, the isolation wall may comprise a plurality of isolation units that are arranged periodically, where each isolation unit may comprise a first unit structure forming the periodic conductive structure on the first side of the dielectric board and a second unit structure forming the periodic conductive structure on the second side of the dielectric board. A position of the first unit structure included in each isolation unit on the first side of the dielectric board may correspond to a position of the second unit structure included in that isolation unit on the second side of the dielectric board. In some embodiments, as viewed from a direction perpendicular to the first and second sides, the center of each first unit structure coincides with the center of corresponding second unit structure.

The first unit structure may be equivalent to an inductor, the second unit structure may be equivalent to a capacitor, thereby the isolation unit comprising the first unit structure and the second unit structure that are correspondingly disposed may be equivalent to an LC resonant circuit. In some embodiments, the isolation unit may be configured to be equivalent to a parallel LC resonant circuit. A frequency range that the frequency selective surface allows to pass therethrough may be adjusted to a desired frequency range by designing the equivalent inductance of the first unit structure and the equivalent capacitance of the second unit structure.

In some embodiments, the periodic conductive structure on the first side of the dielectric board comprises a grid array structure, the first unit structure comprises a grid serving as a repetition unit in the grid array structure, and the periodic conductive structure on the second side of the dielectric board comprises a patch array structure, the second unit structure comprises a patch serving as a repetition unit in the patch array structure. For example, the grid of the first unit structure may have a shape of a regular polygon such as a square, the patch of the second unit structure may also have a shape of a regular polygon such as a square.

The first unit structure may further comprise additional structures on the basis of the grid. In some embodiments, the first unit structure may further comprise projecting portions projecting from corners of the grid towards a center of the grid and/or projecting portions projecting from middle points of sides of the grid towards the center of the grid. The projecting portions may have a strip shape or a substantially strip shape, a cross shape or a substantially cross shape, or may have other suitable shapes. The cross shape as described herein comprises two strip shapes perpendicular to each other. The projecting portions may not meet one other.

Several exemplary configurations of the frequency selective surface of the isolation wall of base station antennas according to the embodiments of the present disclosure are described in detail below with reference to FIGS. 8A-10C.

In some embodiments, the first unit structure comprises a square grid, and the second unit structure comprises a square patch.

Figure 8A:
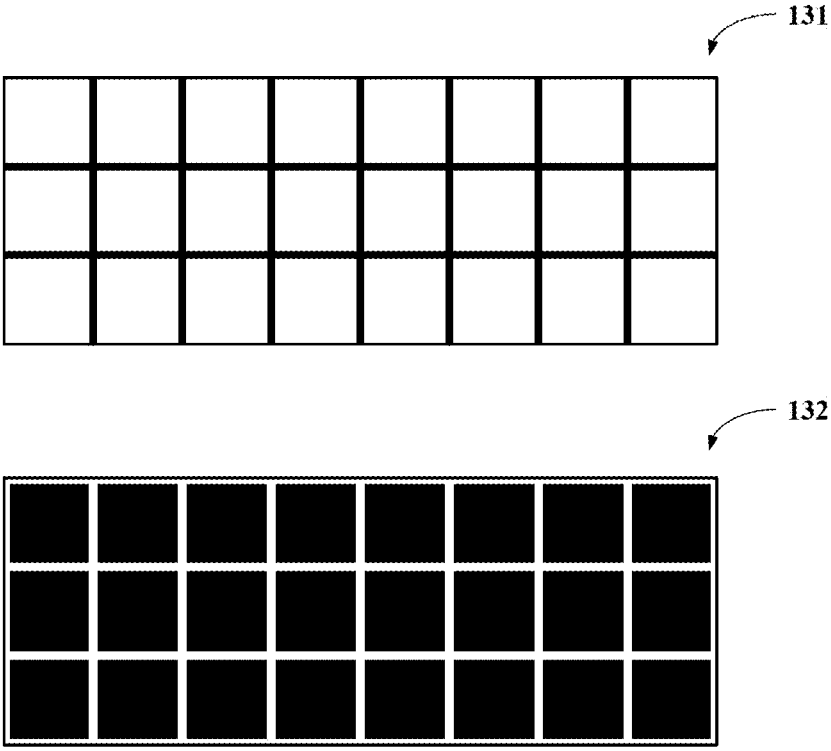
FIG. 8A shows periodic conductive structures of a frequency selective surface of an isolation wall of a base station antenna according to some embodiments of the present disclosure.
Figure 8B:
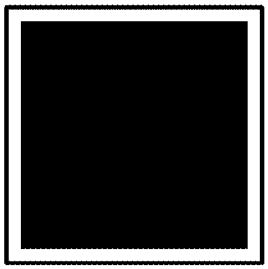
FIG. 8B shows an isolation unit of the isolation wall including the frequency selective surface having the periodic conductive structures as shown in FIG. 8A.

For example, as shown in FIG. 8A, the first unit structure of the periodic conductive structure on the first side 131 is a square grid, the second unit structure of the periodic conductive structure on the second side 132 is a square patch. FIG. 8B shows an isolation unit of the isolation wall including the frequency selective surface having the periodic conductive structures as shown in FIG. 8A, the isolation unit comprising a square grid (first unit structure) and a square patch (second unit structure) at corresponding positions on both sides of the dielectric board (i.e., the dielectric board is omitted in FIG. 8B). As viewed from a direction perpendicular to the first and second sides, the center of the square grid coincides with the center of the square patch. Such an isolation unit may be configured to be equivalent to a parallel resonant circuit formed by an inductor (the square grid) and a capacitor (the square patch). The magnitudes of the inductance of the inductor and the capacitance of the capacitor of the equivalent parallel resonant circuit may be determined based on desired frequency selectivity of the frequency selective surface, and then the sizes of the square grid and the square patch can be determined accordingly. In the example of FIG. 8A, the isolation wall is shown to include isolation units in three rows and eight columns, however, it will be appreciated that this is a non-limiting example, the arrangement of the isolation units may be determined based on desired height and length of the isolation wall and the designed sizes of the unit structures.

Figure 8C:
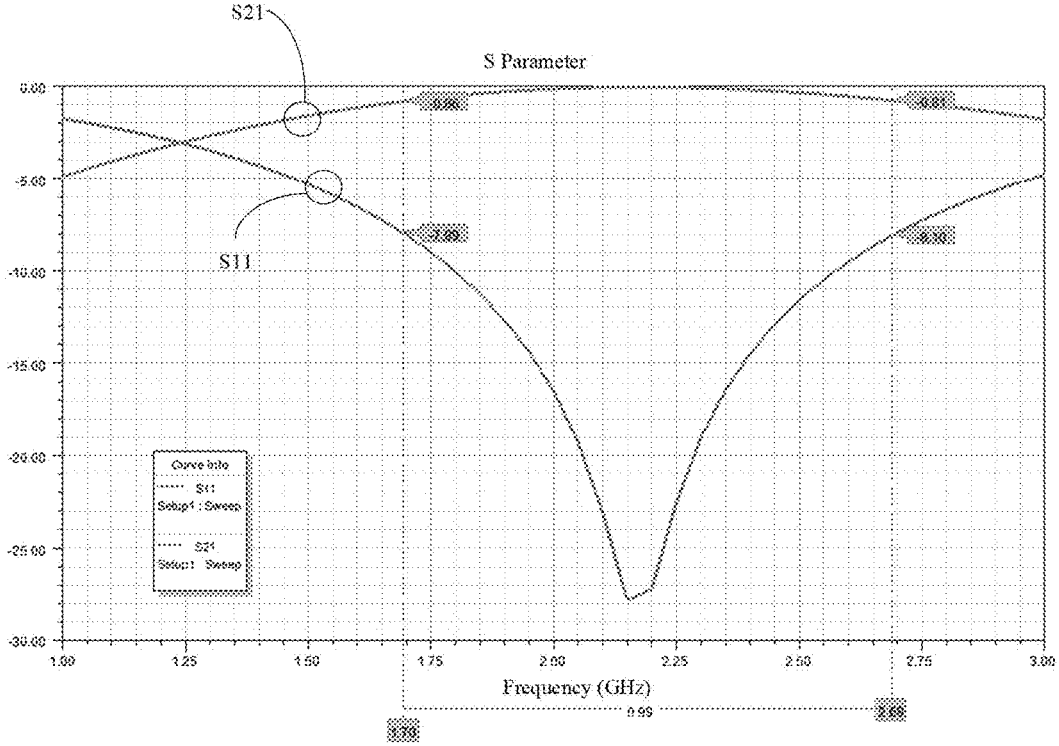
FIG. 8C depicts S parameters of the isolation wall including the frequency selective surface having the periodic conductive structures as shown in FIG. 8A as a function of frequency.

FIG. 8C shows S parameters of the isolation wall including the frequency selective surface having the periodic conductive structures as shown in FIG. 8A and designed for a pass band covering the 1695-2690 MHz frequency band as a function of frequency, where the unit structures of the periodic conductive structures of the frequency selective surface of the isolation wall have a size of 28 mm×28 mm. In FIG. 8C, the S11 parameter represents the reflection by the isolation wall at different frequencies, and the S21 parameter represents the transmission by the isolation wall at different frequencies. It can be seen from FIG. 8C that the S21 parameter of the isolation wall within a frequency range of 1.70-2.69 GHz is not less than −0.86 dB, which exhibits as a "transparent window" for the 1695-2690 MHz frequency band (i.e., the insertion loss of the isolation wall for the 1695-2690 MHz frequency band is less than 1 dB). Further, the S11 parameter of the isolation wall within a frequency range below 1.00 GHz is larger than −2.00 dB, that is, most of the electromagnetic waves within the low frequency band (such as 600-960 MHz) as used herein may be reflected by the isolation wall. Therefore, such isolation wall can effectively reduce the mutual coupling between columns of low-band radiating elements and thus improve inter-band isolation performance of the columns of low-band radiating elements, while at the same time the performance of columns of higher-band (such as 1695-2690 MHz) radiating elements will not be influenced.

In some embodiments, the first unit structure comprises a square grid, the second unit structure comprises a square patch, and the first unit structure further comprises strip-shaped projecting portions projecting from four corners of the square grid towards a center of the square grid. In some examples, the strip-shaped projecting portions of the first unit structure are at an angles of about 45 degrees with respect to the sides of the square grid. In some examples, the respective strip-shaped projecting portions of the first unit structure have the same size as each other. In some examples, the respective strip-shaped projecting portions of the first unit structure do not intersect.

Figure 9A:
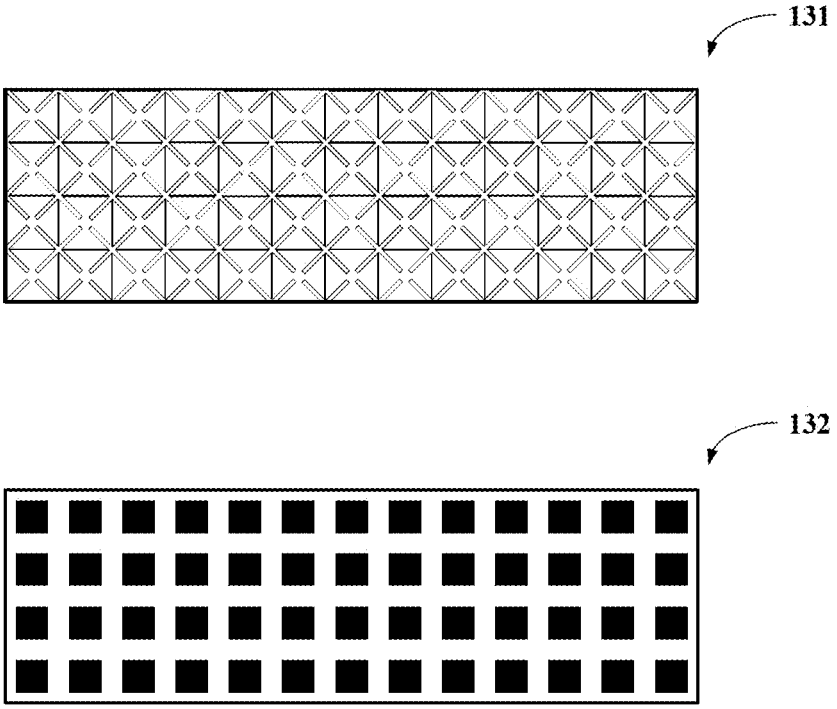
FIG. 9A shows periodic conductive structures of a frequency selective surface of an isolation wall of a base station antenna according to some embodiments of the present disclosure.
Figure 9B:
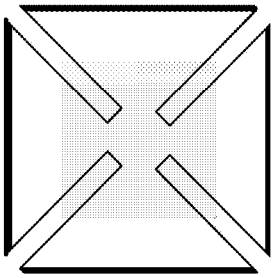
FIG. 9B shows an isolation unit of the isolation wall including the frequency selective surface having the periodic conductive structures as shown in FIG. 9A.

For example, as shown in FIG. 9A, the first unit structure of the periodic conductive structure on the first side 131 comprises a square grid and strip-shaped projecting portions projecting from four corners of the square grid towards a center of the square grid, each strip-shaped projecting portion is at an angle of 45 degrees with respect to the sides of the square grid and do not intersect one another, and the second unit structure of the periodic conductive structure on the second side 132 comprises a square patch. FIG. 9B shows an isolation unit of the isolation wall including the frequency selective surface having the periodic conductive structures as shown in FIG. 9A, the isolation unit comprising the first unit structure and the second unit structure at corresponding positions on both sides of the dielectric board. As viewed from a direction perpendicular to the first and second sides, the center of the first unit structure coincides with the center of the second unit structure. Such an isolation unit may be equivalent to a parallel resonant circuit formed by an inductor (the first unit structure) and a capacitor (the second unit structure). The magnitudes of the inductance of the inductor and the capacitance of the capacitor of the equivalent parallel resonant circuit may be determined based on desired frequency selectivity of the frequency selective surface, and then the sizes of the first and second unit structures can be determined accordingly. In the example of FIG. 9A, the isolation wall is shown to include isolation units in four rows and thirteen columns, however, it will be appreciated that this is a non-limiting example, the arrangement of the isolation units may be determined based on desired height and length of the isolation wall and the designed sizes of the unit structures.

Figure 9C:
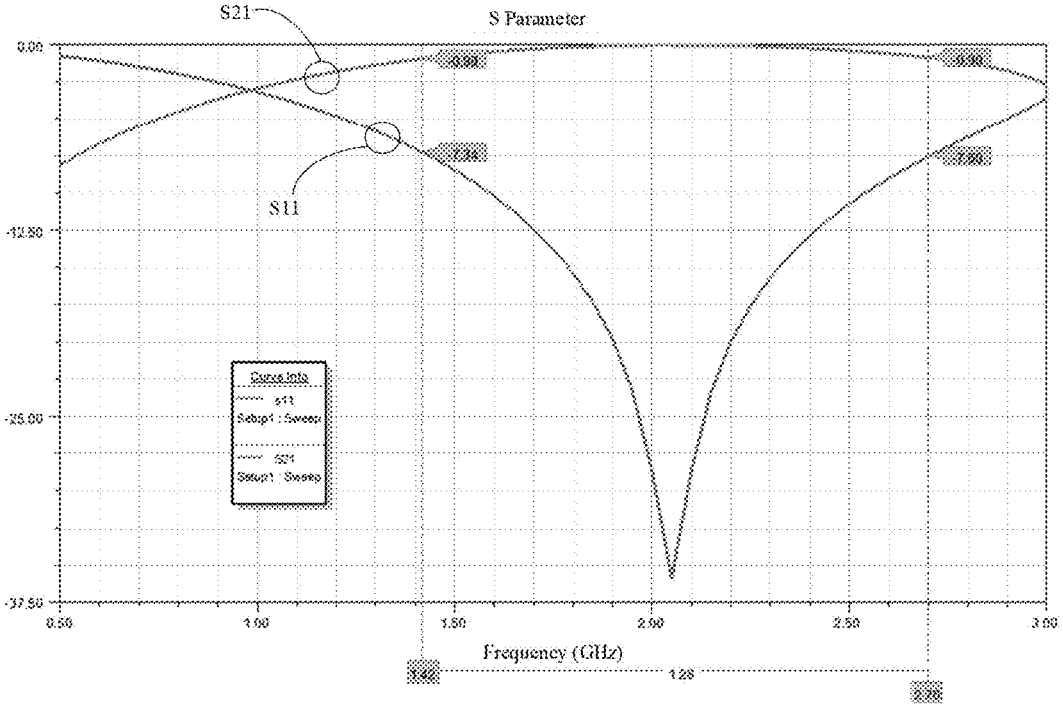
FIG. 9C depicts S parameters of the isolation wall including the frequency selective surface having the periodic conductive structures as shown in FIG. 9A as a function of frequency.

FIG. 9C shows S parameters of the isolation wall including the frequency selective surface having the periodic conductive structures as shown in FIG. 9A and designed for a pass band covering the 1400-2700 MHz frequency band as a function of frequency, wherein the unit structures of the periodic conductive structures of the frequency selective surface of the isolation wall have a size of 16 mm×16 mm. In FIG. 9C, the S11 parameter represents the reflection by the isolation wall at different frequencies, the S21 parameter represents the transmission by the isolation wall at different frequencies. It can be seen from FIG. 9C that the S21 parameter of the isolation wall within a frequency range of 1.42-2.70 GHz is not less than −0.98 dB, which exhibits as a "transparent window" for the 1400-2700 MHz frequency band. Further, the S11 parameter of the isolation wall within a frequency range of 0.50-1.00 GHz is larger than −3 dB, that is, most of the electromagnetic waves within the low frequency band (such as 600-960 MHz) may be reflected by the isolation wall. Therefore, such an isolation wall can effectively reduce the mutual coupling between columns of low-band radiating elements and thus improve inter-band isolation performance of the columns of low-band radiating elements, at the same time the performance of columns of high-band (such as 1400-2700 MHz) radiating elements will not be influenced. As compared to the example of FIG. 8C, since the frequency selective surface of the isolation wall of FIG. 9C has a pass band covering the whole 1400-2700 MHz frequency band, it can ensure that the influence of the isolation wall on the high-band radiating elements is small while reducing the mutual coupling between columns of low-band radiating elements.

In some embodiments, the first unit structure comprises a square grid, the second unit structure comprises a square patch, the first unit structure further comprises cross-shaped projecting portions projecting from four corners of the square grid towards a center of the square grid and strip-shaped projecting portions projecting from middle points of four sides of the square grid towards the center of the square grid, the cross-shaped projecting portions comprising two strip-shaped portions perpendicular to each other. In some examples, the strip-shaped projecting portions included in the first unit structure extend perpendicular to respective sides of the square grid included in the first unit structure. In some examples, longitudinal axes of the cross-shaped projecting portions included in the first unit structure are at angles of 45 degrees with respect to the sides of the square grid included in the first unit structure. In some examples, the strip-shaped projecting portions included in the first unit structure have the same size as each other. In some examples, the cross-shaped projecting portions included in the first unit structure have the same size as each other. In some examples, the respective strip-shaped projecting portions and the respective cross-shaped projecting portions of the first unit structure do not intersect one another.

Figure 10A:
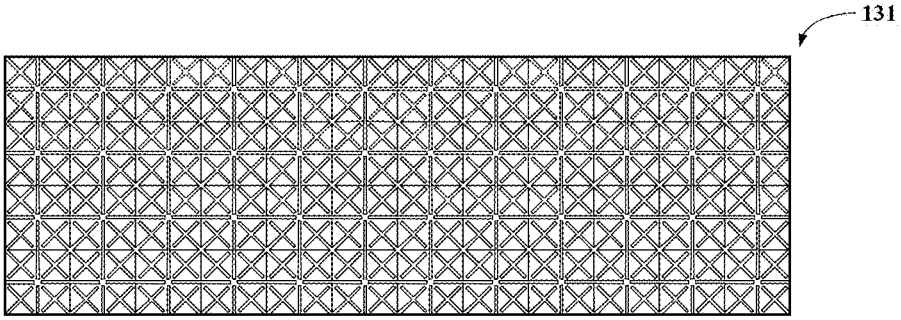
FIG. 10A shows periodic conductive structures of a frequency selective surface of an isolation wall of a base station antenna according to some embodiments of the present disclosure.
Figure 10A:
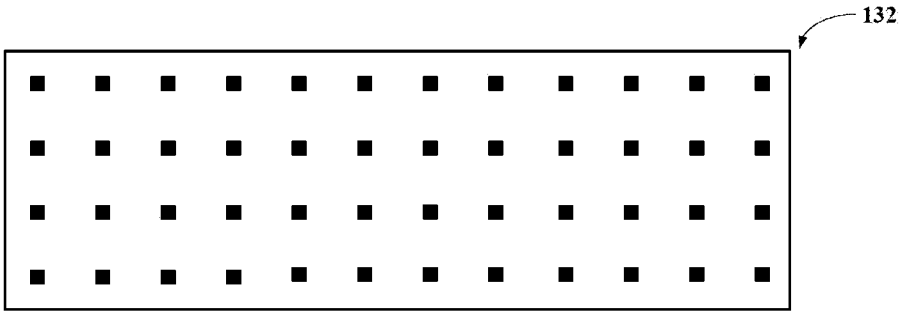
Figure 10B:
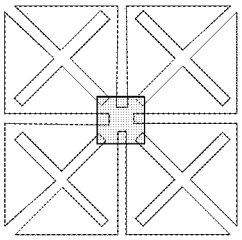
FIG. 10B shows an isolation unit of the isolation wall including the frequency selective surface having the periodic conductive structures as shown in FIG. 10A.

For example, as shown in FIG. 10A, the first unit structure of the periodic conductive structure on the first side 131 comprises a square grid, cross-shaped projecting portions projecting from four corners of the square grid towards a center of the square grid, and strip-shaped projecting portions projecting from middle points of four sides of the square grid towards the center of the square grid. Each cross-shaped projecting portion comprises two strip-shaped portions that are perpendicular to each other and longitudinal axes of each cross-shaped projecting portion are at angles of 45 degrees with respect to the sides of the square grid included in the first unit structure. The strip-shaped projecting portions extend perpendicular to respective sides of the square grid. The respective strip-shaped projecting portions and the respective cross-shaped projecting portions do not intersect one another. The second unit structure of the periodic conductive structure on the second side 132 comprises a square patch. FIG. 10B shows an isolation unit of the isolation wall including the frequency selective surface having the periodic conductive structures as shown in FIG. 10A, the isolation unit comprising the first unit structure and the second unit structure at corresponding positions on both sides of the dielectric board. As viewed from a direction perpendicular to the first and second sides, the center of the first unit structure coincides with the center of the second unit structure. Such an isolation unit may be equivalent to a parallel resonant circuit formed by an inductor (the first unit structure) and a capacitor (the second unit structure). The magnitudes of the inductance of the inductor and the capacitance of the capacitor of the equivalent parallel resonant circuit may be determined based on desired frequency selectivity of the frequency selective surface, and then the sizes of the first and second unit structures can be determined accordingly. In the example of FIG. 10A, the isolation wall is shown to include isolation units in four rows and twelve columns, however, it will be appreciated that this is a non-limiting example, the arrangement of the isolation units may be determined based on desired height and length of the isolation wall and the designed sizes of the unit structures.

Figure 10C:
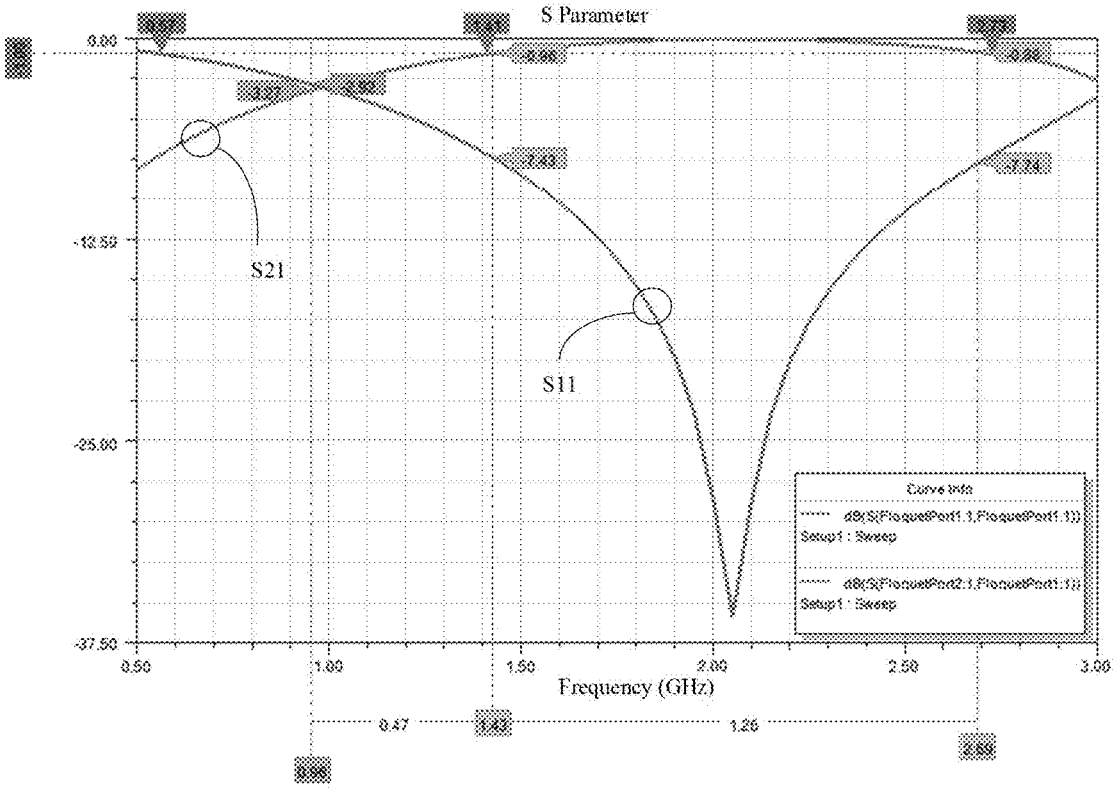
FIG. 10C depicts S parameters of the isolation wall including the frequency selective surface having the periodic conductive structures as shown in FIG. 10A as a function of frequency.

FIG. 10C shows S parameters of the isolation wall including the frequency selective surface having the periodic conductive structures as shown in FIG. 10A and designed for a pass band covering the 1400-2700 MHz frequency band as a function of frequency, wherein the unit structures of the periodic conductive structures of the frequency selective surface of the isolation wall have a size of 12 mm×12 mm. In FIG. 10C, the S11 parameter represents the reflection by the isolation wall at different frequencies, the S21 parameter represents the transmission by the isolation wall at different frequencies. It can be seen from FIG. 10C that the S21 parameter of the isolation wall within a frequency range of 1.41-2.73 GHz is not less than −1.00 dB, which exhibits as a "transparent window" for the 1400-2700 MHz frequency band. Further, the S11 parameter of the isolation wall within a frequency range of 0.50-0.96 GHz is not less than −2.92 dB, that is, most of the electromagnetic waves within the low frequency band (such as 600-960 MHz) as used herein may be reflected by the isolation wall. Therefore, the isolation wall can effectively reduce the mutual coupling between columns of low-band radiating elements and thus improve inter-band isolation performance of the columns of low-band radiating elements, while at the same time the performance of columns of high-band (such as 1400-2700 MHz) radiating elements will not be influenced. As compared to the example of FIG. 8C, since the frequency selective surface of the isolation wall of FIG. 10C has a pass band covering the entire 1400-2700 MHz frequency band, it can ensure that the influence of the isolation wall on the columns of high-band radiating elements is small while reducing the mutual coupling between columns of low-band radiating elements. Although the frequency selective surface of the isolation wall in FIG. 10C has a pass band similar to that of the frequency selective surface of the isolation wall in FIG. 9C, the unit structures of the isolation wall of FIG. 10C is smaller as compared to the example of FIG. 9C, the isolation wall of FIG. 10C can have more unit structures arranged periodically in the case where the overall sizes of the isolation walls are the same, the equivalent resultant frequency selective characteristics at the macro level become more significant as there are more periods.

In the example patterns shown in FIGS. 8A, 9A, and 10A, conductive materials are present at positions of black lines and black blocks, and are not present at white positions. Conductive materials may be deposited at both sides of the dielectric board and then respective patterns may be formed by etching technologies such as photolithography, thereby forming periodic conductive structures to realize the frequency selective surface. Any other suitable methods currently know or developed later in the art may be employed to form desired periodic conductive structures on the dielectric board. The periodic conductive structures may be formed using any suitable conductive materials, typically using metal such as copper, silver, aluminum, and the like. The dielectric board may employ, for example, a printed circuit board. The thickness, dielectric constant, magnetic permeability and other parameters of the dielectric board may affect the coupling strength between the columns of radiating elements at the same frequency band located at both sides thereof, which may be determined depending on desired inter-band isolation performance.

In the examples shown by FIGS. 8A-10C, the frequency selective surface of the isolation wall is configured such that electromagnetic waves within the first operational frequency band (such as 600-960 MHz frequency band) are substantially reflected by the isolation wall, however, it will be appreciated that, the frequency selective surface of the isolation wall may also be configured such that electromagnetic waves within the first operational frequency band (such as 600-960 MHz frequency band) are substantially absorbed by the isolation wall.

Compared to conventional isolation walls including wave-absorbing materials (e.g., a metal isolation wall), the isolation wall of the present disclosure has frequency selectivity, which can effectively reduce the mutual coupling between columns of low-band radiating elements, while at the same time not significantly impacting the performance of the high-band radiating elements, and the radiation patterns generated by the columns of low-band radiating elements and the columns of high-band radiating elements will not be influenced. Moreover, the isolation wall of the present disclosure may have lower loss and/or lower cost.

Another aspect of the present disclosure provides a multi-band base station antenna comprising: a plurality of columns of low-band radiating elements configured for operating in a low frequency band, each column of low-band radiating elements comprising a plurality of low-band radiating elements arranged in a longitudinal direction; a plurality of columns of high-band radiating elements configured for operating in a high frequency band that is higher than and does not overlap with the low frequency band, each column of high-band radiating elements comprising a plurality of high-band radiating elements arranged in the longitudinal direction; and an isolation wall positioned between adjacent columns of low-band radiating elements and extending in the longitudinal direction, where the isolation wall comprises a frequency selective surface configured to reflect electromagnetic waves within the low frequency band while enabling electromagnetic waves within the high frequency band to propagate through the isolation wall. The "low frequency band" as used herein refers to a lower frequency band such as 600-960 MHz, and the "high frequency band" as used herein refers to a higher frequency band such as 1400-2700 MHz. The present disclosure is not limited to these particular frequency bands, and may also be applied to other multi-band configurations.

Some of the multi-band base station antennas according to the present disclosure may be described with reference to FIG. 4. The multi-band base station antenna of FIG. 4 comprises a plurality of columns 110-1, 110-2 of low-band radiating elements configured for operating in a low frequency band (such as 600-960 MHz), each column 110-1, 110-2 of low-band radiating elements comprises a plurality of low-band radiating elements 111 arranged in a longitudinal direction. The multi-band base station antenna further comprises a plurality of columns 120-1, 120-2, 120-3, 120-4 of high-band radiating elements configured for operating in a high frequency band (such as 1400-2700 MHz) that is higher than and does not overlap with the low frequency band, each column 120-1, 120-2, 120-3, 120-4 of high-band radiating elements comprises a plurality of high-band radiating elements 121 arranged in the longitudinal direction. The multi-band base station antenna further comprises an isolation wall 130 positioned between adjacent columns 110-1, 110-2 of low-band radiating elements and extending in the longitudinal direction, where the isolation wall 130 comprises a frequency selective surface configured to reflect electromagnetic waves within the low frequency band while enabling electromagnetic waves within the high frequency band to propagate through the isolation wall. It will be appreciated that, except for the illustrated structure, the multi-band base station antenna may comprise more or fewer columns of low-band radiating elements and/or columns of high-band radiating elements, may also additionally comprise columns of radiating elements that operate in other operational frequency bands, and each column of radiating elements may comprise more or fewer radiating elements.

Figure 11:
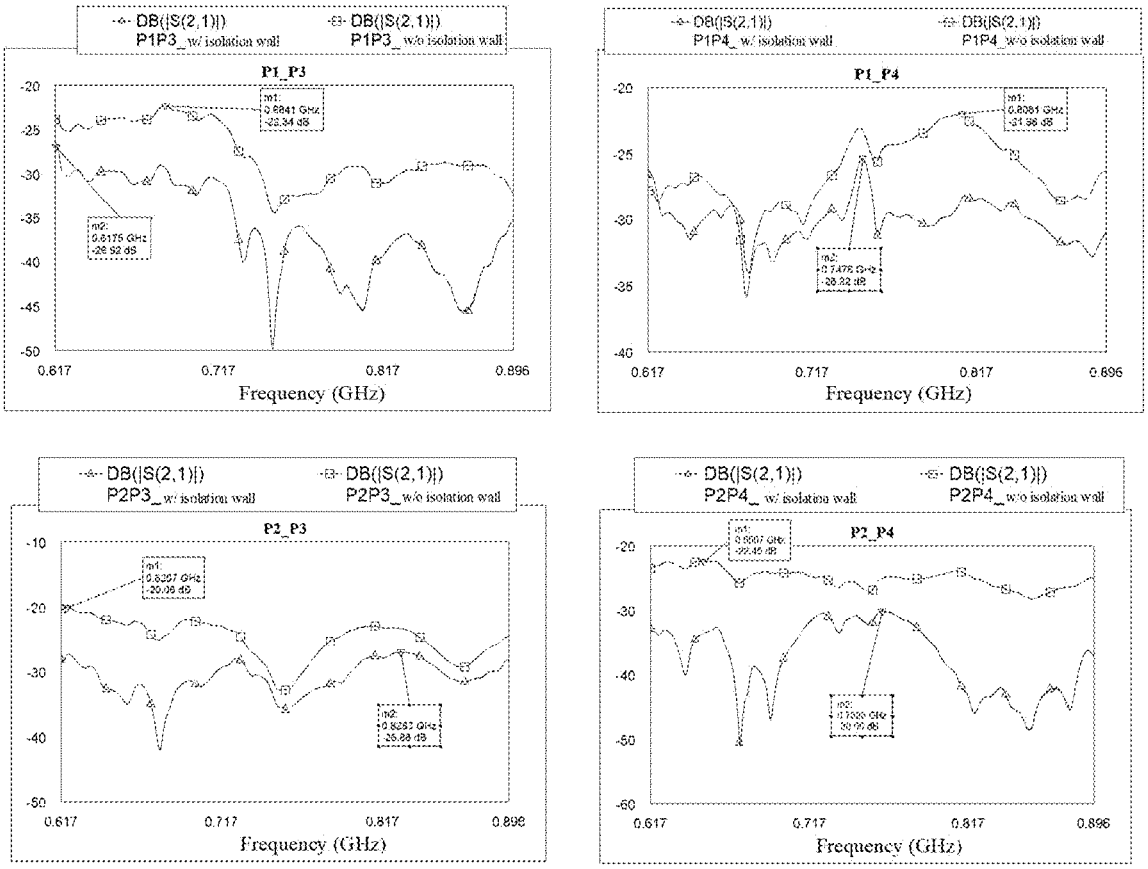
FIG. 11 is a series of graphs depicting mutual coupling strengths between dipole arms of two adjacent low-band radiating elements with an isolation wall therebetween and without an isolation wall therebetween.

FIG. 11 depicts mutual coupling strengths between dipole arms of two adjacent low-band radiating elements with an isolation wall therebetween and without an isolation wall therebetween, the isolation wall has the periodic conductive structures as shown in FIG. 8A and has the reflection and transmission characteristics as shown in FIG. 8C. With reference to FIGS. 5, P1 and P2 are, respectively, positive and negative polarization dipole arms of the low-band radiating element 111-2, P3 and P4 are, respectively, positive and negative polarization dipole arms of the low-band radiating element 111-6. It can be seen from FIG. 11 that, as compared to the case where there is no isolation wall, the mutual coupling strength between P1 and P3, the mutual coupling strength between P1 and P4, the mutual coupling strength between P2 and P3, and the mutual coupling strength between P2 and P4 are all reduced after the isolation wall 130 is disposed between the two adjacent low-band radiating elements 111-2 and 111-6. Therefore, the isolation wall 130 can effectively reduce the mutual coupling between columns of low-band radiating elements, thereby improving inter-band isolation performance of the columns of low-band radiating elements.

The embodiments discussed above regarding the base station antenna comprising a plurality of columns of first radiating elements and a plurality of columns of second radiating elements may be applicable to the multi-band base station antenna according to the present disclosure.

The multi-band base station antennas according to embodiments of the present disclosure may have improved inter-band isolation performance between the columns of low-band radiating elements, at the same time the performance of the columns of high-band radiating elements will not be influenced by the isolation wall, and radiation patterns generated by the columns of low-band radiating elements and the columns of high-band radiating elements will not be influenced by the isolation wall, either.

The terms "left," "right," "front," "back," "top," "bottom," "upper," "lower," "high", "low", and the like in the description and in the claims, if any, are used for descriptive purposes and not necessarily for describing permanent relative positions. It is to be understood that the terms so used are interchangeable under appropriate circumstances such that the embodiments of the disclosure described herein are, for example, capable of operation in other orientations than those illustrated or otherwise described herein. For example, when the apparatus in the figures is turned upside down, features described as "over" other features may be described as "below" other features at this time. The apparatus may also be otherwise oriented (rotated 90 degree or at other orientations) and the relative spatial relationships may be interpreted accordingly.

In the description and claims, when an element is referred to as being "over", "attached to", "connected to", "coupled to", or "contacting" another element or the like, the element may be directly over, directly attached to, directly connected to, directly coupled to or directly contact the other element, or one or more intermediate elements may be present. In contrast, when an element is referred to as being "directly over", "directly attached to", "directly connected to", "directly coupled to", or "directly contacting" another element, there are no intermediate elements present. In the description and claims, one feature may be arranged to be "adjacent to" another feature, which may mean that the one feature has a portion that overlaps with the adjacent feature or has a portion above or below the adjacent feature.

As used herein, the term "exemplary" means "serving as an example, instance, or illustration," and not as a "model" that is to be reproduced exactly. Any implementation exemplarily described herein is not necessarily to be construed as preferred or advantageous over other implementations. Furthermore, the present disclosure is not restricted by any expressed or implied theory presented in the technical field, background, summary of the invention, or detailed description.

As used herein, the term "substantially" is intended to encompass any minor variations due to design or manufacturing imperfections, tolerances of the devices or elements, environmental influences and/or other factors. The term "substantially" also allows for differences from a perfect or ideal situation due to parasitic effect, noise, and other practical considerations that may exist in a practical implementation.

In addition, the terms "first," "second," and the like may also be used herein for reference purposes only, and thus are not intended to be limiting. For example, the terms "first," "second," and other such numerical terms referring to structures or elements do not imply a sequence or order unless clearly indicated by the context.

It will be further understood that the term "include/comprise," when used herein, specify the presence of stated features, entireties, steps, operations, units, and/or components, but do not preclude the presence or addition of one or more other features, entireties, steps, operations, units, and/or components, and/or a combination thereof.

In the present disclosure, the term "providing" is used broadly to encompass all ways of obtaining an object, and thus "providing an object" includes, but is not limited to, "purchasing," "preparing/manufacturing," "arranging/setting," "installing/assembling," and/or "ordering" the object, and the like.

As used herein, the term "and/or" includes any and all combinations of one or more of the associated listed items. The terminology used herein is for the purpose of describing particular embodiments only and is not intended to limit the present disclosure. As used herein, the singular forms "a," "an" and "the" are intended to include the plural forms as well, unless the context clearly indicates otherwise.

Those skilled in the art shall appreciate that the boundaries between the above described operations are merely illustrative. Multiple operations may be combined into a single operation, a single operation may be distributed in additional operations, and operations may be performed at least partially overlapping in time. Moreover, alternative embodiments may include multiple instances of a particular operation, and the order of operations may be altered in various other embodiments. However, other modifications, variations, and alternatives are also possible. The aspects and elements of all embodiments disclosed above may be combined in any manner and/or in combination with aspects or elements of the other embodiments to provide multiple additional embodiments. The specification and drawings are, accordingly, to be regarded in an illustrative rather than a restrictive sense.

Although some specific embodiments of the present disclosure have been described in detail by way of example, it should be understood by those skilled in the art that the above examples are for illustration only and are not intended to limit the scope of the present disclosure. The various embodiments disclosed herein may be combined in any manner without departing from the spirit and scope of the present disclosure. Those skilled in the art will also appreciate that various modifications might be made to the embodiments without departing from the scope and spirit of the present disclosure. The scope of the present disclosure is defined by the attached claims.

That which is claimed is:

1. A base station antenna that extends along a longitudinal direction, the base station antenna comprising:

a plurality of columns of first radiating elements configured for operating in a first operational frequency band, each column of first radiating elements comprising a plurality of first radiating elements arranged in the longitudinal direction; and an isolation wall positioned between adjacent columns of first radiating elements and extending in the longitudinal direction, wherein the isolation wall comprises a frequency selective surface configured such that electromagnetic waves within the first operational frequency band are substantially blocked by the isolation wall, wherein the isolation wall comprises a dielectric board having opposite first and second sides, the first and second sides facing respective columns of first radiating elements, each formed with a periodic conductive structure, the periodic conductive structures forming the frequency selective surface.

2. The base station antenna of claim 1, wherein the frequency selective surface is configured to reflect the electromagnetic waves within the first operational frequency band.

3. The base station antenna of claim 1, further comprising a plurality of columns of second radiating elements configured for operating in a second operational frequency band that is different from and does not overlap with the first operational frequency band, each column of second radiating elements comprising a plurality of second radiating elements arranged in the longitudinal direction, wherein the frequency selective surface is further configured such that electromagnetic waves within the second operational frequency band can propagate through the isolation wall.

4. The base station antenna of claim 3, wherein the second operational frequency band is higher than the first operational frequency band.

5. The base station antenna of claim 1, wherein the isolation wall comprises a plurality of isolation units arranged periodically, each isolation unit comprising a first unit structure forming the periodic conductive structure on the first side of the dielectric board and a second unit structure forming the periodic conductive structure on the second side of the dielectric board, a position of the first unit structure included in each isolation unit on the first side of the dielectric board corresponding to a position of the second unit structure included in that isolation unit on the second side of the dielectric board.

6. The base station antenna of claim 5, wherein the periodic conductive structure on the first side of the dielectric board comprises a grid array structure, the first unit structure comprises a grid serving as a repetition unit in the grid array structure, and the periodic conductive structure on the second side of the dielectric board comprises a patch array structure, the second unit structure comprises a patch serving as a repetition unit in the patch array structure.

7. The base station antenna of claim 6, wherein the first unit structure further comprises projecting portions projecting from corners of the grid towards a center of the grid and/or projecting portions projecting from middle points of sides of the grid towards the center of the grid.

8. The base station antenna of claim 7, wherein the projecting portions have a strip shape or a cross shape, the cross shape comprising two strip shapes perpendicular to each other.

9. The base station antenna of claim 6, wherein the first unit structure comprises a square grid, and the second unit structure comprises a square patch.

10. The base station antenna of claim 9, wherein the first unit structure further comprises strip-shaped projecting portions projecting from four corners of the square grid towards a center of the square grid.

11. The base station antenna of claim 1, wherein the base station antenna comprises a plurality of isolation walls, each isolation wall disposed at different rows of radiating elements between the adjacent columns of first radiating elements.

12. The base station antenna of claim 1, wherein a height of the isolation wall is larger than a height of a first radiating element of the plurality of first radiating elements.

13. The base station antenna of claim 1, wherein the isolation wall is implemented as a multi-layer printed circuit board, one or more layers of which formed with a frequency selective surface configured such that electromagnetic waves within a predetermined frequency range cannot propagate through the isolation wall, and wherein a combination of predetermined frequency ranges associated with the one or more layers of the multi-layer printed circuit board covers the first operational frequency band.

14. A base station antenna that extends along a longitudinal direction, the base station antenna comprising:

a plurality of columns of first radiating elements configured for operating in a first operational frequency band, each column of first radiating elements comprising a plurality of first radiating elements arranged in the longitudinal direction; and an isolation wall positioned between adjacent columns of first radiating elements and extending in the longitudinal direction, wherein the isolation wall comprises a frequency selective surface configured such that electromagnetic waves within the first operational frequency band are substantially blocked by the isolation wall; and a parasitic element disposed on top of the isolation wall.

15. A base station antenna that extends along a longitudinal direction, the base station antenna comprising:

a plurality of columns of first radiating elements configured for operating in a first operational frequency band, each column of first radiating elements comprising a plurality of first radiating elements arranged in the longitudinal direction;

a plurality of columns of second radiating elements configured for operating in a second operational frequency band that is different from and does not overlap with the first operational frequency band, each column of second radiating elements comprising a plurality of second radiating elements arranged in the longitudinal direction;

a first isolation wall positioned between adjacent columns of first radiating elements and extending in the longitudinal direction, wherein the first isolation wall comprises a frequency selective surface configured such that electromagnetic waves within the first operational frequency band are substantially blocked by the first isolation wall; and a second isolation wall positioned between adjacent columns of second radiating elements and extending in the longitudinal direction, the second isolation wall comprising a frequency selective surface configured such that the electromagnetic waves within the second operational frequency band are substantially blocked by the second isolation wall.

16. The base station antenna of claim 15, wherein the first isolation wall is also positioned between the adjacent columns of second radiating elements, and the second isolation wall is also positioned between the adjacent columns of first radiating elements.

17. The base station antenna of claim 16, comprising a plurality of the first isolation walls and a plurality of the second isolation walls arranged alternately in a column, wherein each first isolation wall is disposed at different rows of radiating elements between the adjacent columns of first radiating elements, and each second isolation wall is disposed at different rows of radiating elements between the adjacent columns of second radiating elements.

18. The base station antenna of claim 15, wherein the second operational frequency band is higher than the first operational frequency band.

* * * * *